US007207088B2

(12) United States Patent
Adams et al.

(10) Patent No.: US 7,207,088 B2
(45) Date of Patent: Apr. 24, 2007

(54) DOOR HOOK WITH REMOVABLE SPACER

(75) Inventors: William E. Adams, Harmony, PA (US); George LeMieux, Noblesville, IN (US)

(73) Assignee: Adams Mfg. Corp., Portersville, PA (US)

( * ) Notice: Subject to any disclaimer, the term of this patent is extended or adjusted under 35 U.S.C. 154(b) by 13 days.

(21) Appl. No.: 10/790,428

(22) Filed: Mar. 1, 2004

(65) Prior Publication Data

US 2005/0188507 A1 Sep. 1, 2005

(51) Int. Cl.
*A45F 5/10* (2006.01)
*E05D 13/00* (2006.01)

(52) U.S. Cl. ..... 16/413; 248/215; 248/304; 248/914; 16/404

(58) Field of Classification Search ..... 16/413, 16/404; 248/215, 304, 914
See application file for complete search history.

(56) References Cited

U.S. PATENT DOCUMENTS 1,474,660 A 11/1923 White
1,540,556 A 6/1925 Laurie
2,743,023 A * 4/1956 Larson ..... 211/96
3,536,286 A 10/1970 Kramer
3,891,176 A * 6/1975 Downing et al. ..... 248/340
3,907,118 A * 9/1975 Pelavin ..... 211/113
4,034,865 A 7/1977 Batts et al.
4,387,873 A * 6/1983 Pavlo et al. ..... 248/227.1
4,709,891 A * 12/1987 Barnett ..... 248/214
4,817,239 A 4/1989 Campbell
D305,299 S * 1/1990 Freeman ..... D8/373
5,087,007 A 2/1992 Gaderick
D326,021 S 5/1992 Evenson (Continued)

OTHER PUBLICATIONS

Photocopy of mainstays™ décor Over Door Hook on blister card which is commercial embodiment of U.S. Patent No. Des. 479,918.

*Primary Examiner*—Brian E. Glessner
*Assistant Examiner*—Mark Williams
(74) *Attorney, Agent, or Firm*—Buchanan Ingersoll & Rooney PC

(57) ABSTRACT

A door hook including a U-shaped bracket having a top member and a front side and back side attached to the top member. The front and back sides are separated by a first distance, which corresponds generally to the thickness of a door over which the door hook is to be placed. A hook is attached to the front side, while a spacer portion is attached to the back side or top. A frangible joint is formed in the back side or top such that the spacer portion can be detached and then reattached to the back side. With the spacer portion in this reattached position the spacer portion and the front side are separated by a second distance, different from and typically less than the first-distance. The second distance corresponds generally to the thickness of a thinner or thicker door, over which the door hook may be placed after removal or removal and reattachment of the spacer. In this manner, the door hook may be easily adjusted to fit over doors having different thickness, such as, for example, exterior doors and interior doors. In an alternative embodiment the spacer portion is positioned to fit over a thinner door with the spacer portion in place and over a thicker door when the spacer portion is removed.

15 Claims, 5 Drawing Sheets

U.S. PATENT DOCUMENTS

| | | | | |
|---|---|---|---|---|
| D340,672 | S | 10/1993 | Adams | |
| D342,889 | S | 1/1994 | Adams | |
| 5,413,297 | A | 5/1995 | Adams | |
| 5,515,981 | A * | 5/1996 | Gregory et al. | 211/113 |
| 5,535,971 | A * | 7/1996 | Adams | 248/215 |
| 5,553,823 | A | 9/1996 | Protz, Jr. | |
| D374,168 | S | 10/1996 | Protz, Jr. | |
| D422,198 | S | 4/2000 | Snell | |
| 6,224,030 | B1 | 5/2001 | Hepworth | |
| 6,302,365 | B1 | 10/2001 | Catanzarite et al. | |
| 6,311,851 | B1 | 11/2001 | Knudsen, Sr. et al. | |
| D455,947 | S | 4/2002 | Goodman et al. | |
| D479,981 | S | 9/2003 | Snell | |
| 2002/0144962 | A1 * | 10/2002 | Dettorre et al. | 211/85.7 |

* cited by examiner

DOOR HOOK WITH REMOVABLE SPACER

FIELD OF THE INVENTION

The present invention is directed toward over-the-door hooks and, more particularly, toward an over-the door hook capable of being used with doors having different thickness.

BACKGROUND OF THE INVENTION

There are a variety of hooks that fit over the top of a door. One common type of hook has a U-shaped bracket having an opening not greater than the thickness of the door to which it is to be attached. One or more hooks extend from either or both sides of the bracket. Examples of this type of door hook are disclosed in U.S. Pat. No. 4,817,239 to Campbell et al. and U.S. Pat. No. 6,302,365 to Catanzarite et al. and U.S. Design Pat. No. Des. 342,889 to Adams, U.S. Pat. Des. No. 422,198 to Snell and U.S. Pat. Des. No. 455,947 to Goodman et al. These door hooks are made of plastic or metal and are unitary structures. One shortcoming of this type of hook is that the bracket is sized to fit doors having the same thickness or a slightly smaller thickness as the opening in the bracket. The hooks are not adjustable either in the width of the bracket or the level at which the hook portion is positioned relative to the top of the door. Consequently, the art has recognized a need for an over-the-door hook that will fit over a wider range of door thickness.

One type of over-the-door hook that will fit a wider range of doors is disclosed in U.S. Pat. No. Des. 326,021 to Evenson. That door hook has two L-shaped members that fit together in a manner to form an adjustable U-shaped hook. The two L-shaped members are connected by a tongue and groove type joint that enables them to slide apart from and toward one another thereby changing the width of the hook. A significant shortcoming of this hook is the thickness of that portion of the hook that fits on top of the door. That thickness prevents many doors from being tightly closed. Another approach to providing a door hook that fits over a wider range of door thickness is to provide a U-shaped bracket in which the legs of the bracket angle toward one another and can flex away from one another. One such hook is disclosed in my U.S. Pat. No. Des. 342,889. This type of hook is more likely to jam and to slide and be pulled off the door than is a door hook having the bracket with an opening that is the same as the thickness of the door.

In designing an over-the-door hook, the objective has always been to create an inexpensive hook that will fit the door while that door is open or closed and that will hold significant weight. When the door is open, a door hook with too wide a top tends to slide and be pulled off the door. Clear plastics are often used because they are cheaper than metal and less noticeable. But, it is very difficult to mold thin sections of plastic because plastic does not flow well through thin openings. Consequently, plastic door hooks have been over 0.080 inches thick and many are 0.125 inches thick. Many of these door hooks are too thick to close a door safely without damaging the door. This is particularly true of newer doors that have tight seals between the door and the jamb. The thicker door hooks have, in many cases, actually weakened the very hinges that hold the door, and also compressed and damaged wood in both the door and the jamb. If the over-the-door hook is too thick, the door may not close or when it does close it may not latch. Locks and latches on the door may be forced downward so that they no longer engage openings in the jamb. To avoid this problem the top of an over the door hook should be no more than 0.080 inches thick.

There is a need for an over-the-door hook which can hold significant weight when the door is open, and which permits the door to be closed without damaging the door and which is or can be configured to securely fit over exterior doors which may be typically two inches wide and thinner interior doors which may be 1⅜ to 1¾ inches wide.

SUMMARY OF THE INVENTION

A door hook is provided according to the present invention including a U-shaped metal or plastic bracket having a top member and front and back sides attached to the top member. In a first present preferred embodiment, the front and back sides are separated by a first distance, which corresponds generally to the thickness of the thickest door over which the door hook is intended to be placed. A J-hook is attached to the front side of the U-shaped bracket. A removable spacer is formed as a portion of the back side or at another location on the hook body. A frangible connection is formed in the back side such that the spacer portion is removable from the hook body. Then, the spacer portion can be removed and reattached to the back side. With the spacer portion in its reattached position, the spacer portion and the front side are separated by a second distance, less than the first distance, which corresponds generally to the thickness of a thinner, second door over which the door hook may be placed. In this manner, the door hook of the present invention may be easily configured by the user to fit over doors having different thickness, such as, for example, exterior doors and interior doors.

In one form of the present invention, the spacer portion includes a J-hook. The spacer portion is removed and reattached to allow the door hook to be placed on doors having different thickness. This removal and replacement is equivalent to pivoting the J-hook 180°. The curved segment of the J-hook provides the desired spacing.

The front side of the U-shaped bracket is preferably angled inwardly toward the back side. Similarly, the back side of the U-shaped bracket is also preferably angled inwardly toward the front side. The acute angles between the front side and the top member and/or between the back side and the top member increase the holding power of the door hook but are not required.

In another form of the present invention, an additional J-hook is attached to the back side of the U-shaped bracket. The additional J-hook is positioned between the top member and the spacing member, such that the additional J-hook can be utilized for holding an article with the spacer portion either in its original position or in a removed and reattached position.

Various means can be provided for reattaching the spacer portion. Tabs may be provided on the spacer portion that slide over or snap onto the edges of the back side. Projections or a key may be provided on the spacer portion that are received in holes, slots or a keyhole in the back side or top. Double sided tape, Velcro type fasteners or adhesives can be used.

Another present preferred embodiment is a U-shaped bracket with a spacer portion attached adjacent to the back side. The spacer portion is removable and positioned so that the door hook fits on a thin door when the spacer is in place and fits a thicker door when the spacer portion is removed. The spacer, top, front side and back side of the U-shaped bracket form an integrally molded plastic body.

The U-shaped bracket may be made of polycarbonate, polypropylene, styrene, metal, or other hard, resilient material. Preferably, the top member is approximately 0.050 to 0.080 inches thick to fit between the door top and doorjamb.

It is an object of the present invention to provide a door hook that is thin enough to fit between the top of the door and the jamb, and that is strong enough to hold significant weight, such as a decorative wreath, when the door is open.

It is an additional object of the present invention to provide a door hook that is capable of being easily adjustable to fit securely over door tops of different thickness.

Other objects, aspects and advantages of the present invention can be obtained from a certain present preferred embodiments shown in the drawings.

DETAILED DESCRIPTION OF THE INVENTION

Figure 1:
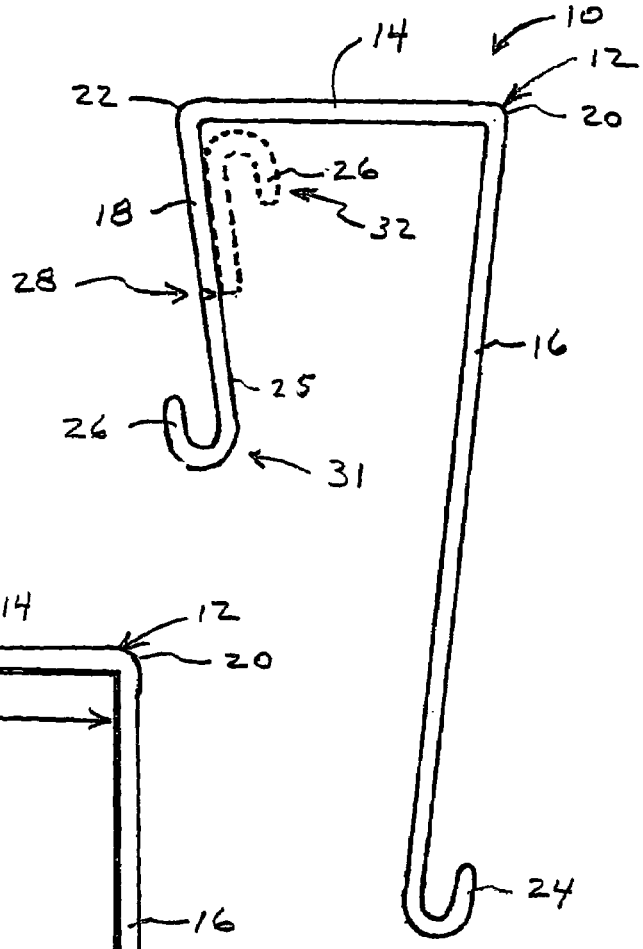
FIG. 1 is a side view of a first embodiment of a door hook according to the present invention.
Figure 2:
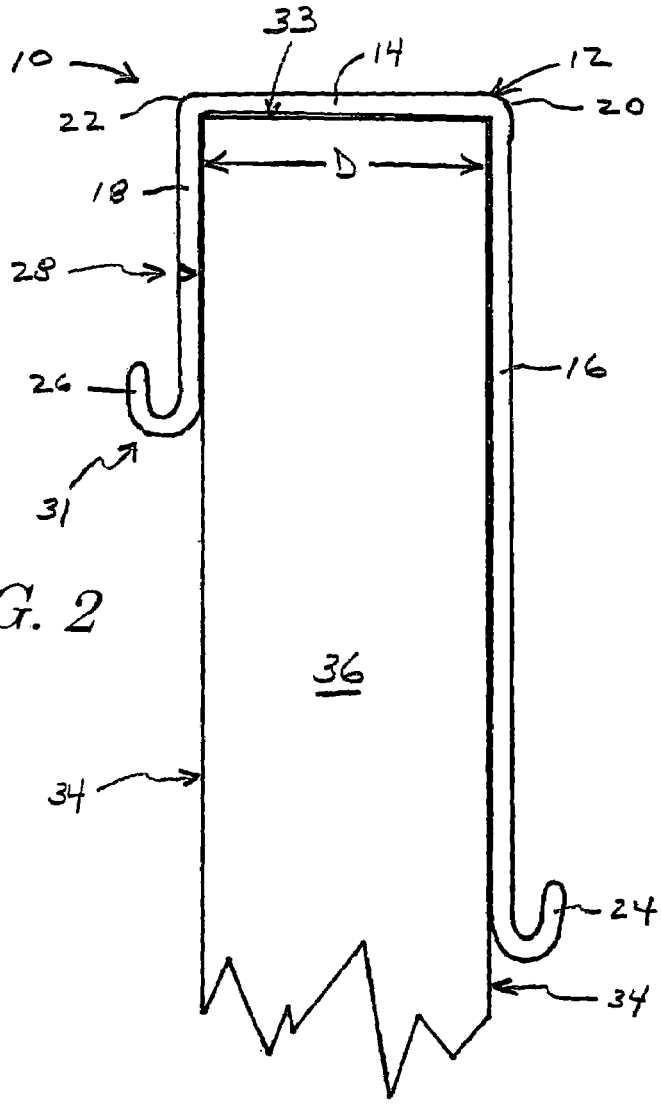
FIG. 2 is a side view of the door hook shown in FIG. 1 secured over a door having a first thickness.
Figure 3:
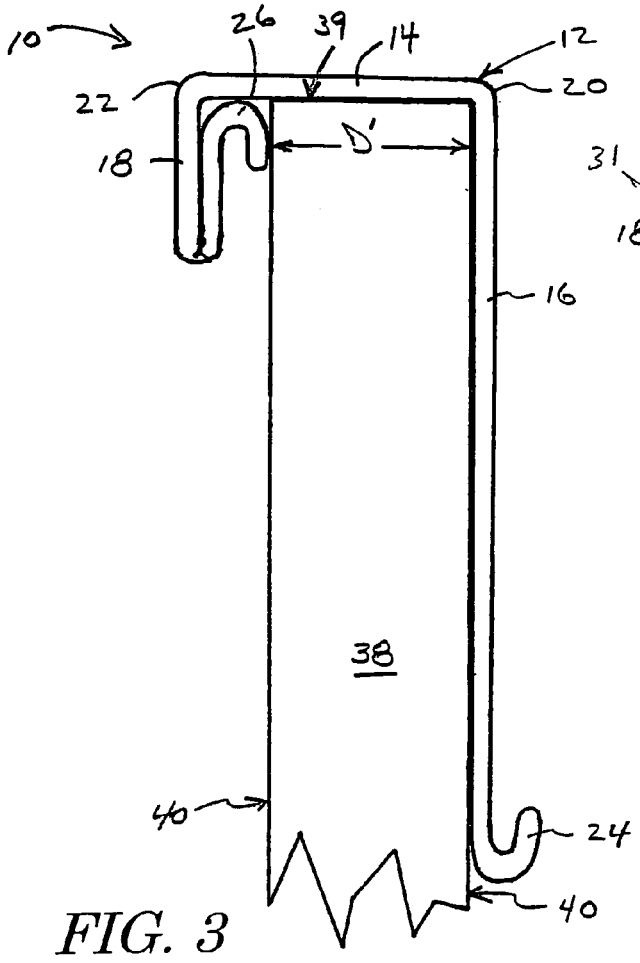
FIG. 3 is a side view of the door hook shown in FIG. 1 secured over a door having a second thickness less than the first thickness.

A first embodiment of our over-the-door hook 10 is illustrated in FIGS. 1, 2, and 3. The door hook 10 includes a U-shaped bracket 12 having a top member 14, a front side 16 and a back side 18. The front side 16 is attached to one edge 20 of the top member 14, preferably at an acute angle relative to the top member 14. The back side 18 is attached to an edge 22 of the top member 14 opposite the edge 20 attached to the front side 16. The back side 18 is also preferably attached at an acute angle relative to the top member 14. A hook 24, such as a J-hook, is attached to the front side 16, typically at an end thereof. A spacer portion 26, that may be configured as a J-hook, is detachably connected to the back side 18 by a frangible joint 28.

The front side 16 and the back side 18 should be at least 1.375 inches long, and the distance between the front side 16 and the back side 18 should be about the same as the thickness of the thickest door on which the hook 10 may be placed. This combination of length and width prevents the bracket 12 from being easily pulled off the door. When one of the front and/or back sides 16, 18 is less than 1.375 inches in length, a wreath or other object of similar weight hung on the other side will pull the hook 10 from the door. Similarly, when the hook 10 is wider than the thickness of the door, it is more easily dislodged by a wreath or other object hung on the hook 10. Therefore, the distance between the front side 16 and the back side 18 at the top should be equal to, or not more than, 0.025 inches greater than the thickness of the door.

The bracket 12 may be made of a hard, resilient polymer material, such as styrene, polypropylene or polycarbonate. Additionally, the bracket 12 may be made of materials such as Lexan, K-resin or metal (brass, stainless steel, etc.) without departing from the spirit and scope of the present invention. The top member 14 is preferably 0.050 to 0.080 inches thick to fit between a vast majority of door tops and jambs. When an object is held on the hook 24, the front side 16 is pulled downward by the weight of the object. The downward force is likely to lift the back side 18 and the top member 14 of the door hook 10. However, the acute angle between the front side 16 and the top member 14 increases the holding power of the door hook 10 and helps to keep the door hook 10 from being lifted. The acute angle between the back side 18 and the top member 14 also increases the holding power of the door hook 10 and helps to keep the door hook 10 from being lifted. The acute angles between the front and back sides and the top member also provide a sung fit on those doors whose thickness is slightly less than the standard size for that type of door. It is preferred that the angle between the front side 16 and top member 14 and between the back side 18 and top member 14 be approximately 85°. However, other angular displacements or straight sides may be utilized without departing from the spirit and scope of the present invention.

A frangible joint 28 formed in the back side 18 enables the spacer portion 26 to be detached from the U-shaped bracket. The spacer portion is then reattached in the position 32, shown in dotted line in FIG. 1. An adhesive 25, such as double sided tape, is provided on the spacer portion, or on the back side or on both surfaces, to reattach and hold the spacer portion.

In FIG. 2, the door hook 10 is positioned over a door 36 having a door top 33 from which sides 34 extend. The spacer portion 26 has not been detached and the front side 16 and back side 18 are separated by a first distance D, which corresponds generally to the thickness of the door 36. Thus, the door hook 10 of the present invention is able to fit snugly over the door 36.

As shown in FIG. 3, with the spacer portion 26 in the reattached position 32, the door hook 10 of the present invention is capable of being snugly fit over a door 38 having a thickness that is less than the thickness of the door 36 in FIG. 2. With the spacer portion 26 reattached, the front side 16 and the spacer portion are separated by a second distance D', which corresponds generally to the thickness of the door 38. With the door hook 10 positioned over the door top 39, the spacer portion 26 and front side 16 fit snugly against the sides 40 of the door 38 to securely fit the door hook 10 to the door 38. Thus, the door hook 10 may be used with doors having different thickness. For example, the door 36 shown in FIG. 2 could be an exterior door, while the door 38 shown in FIG. 3 could be an interior door. Generally, exterior doors are thicker than interior doors. The spacer portion 26 is sized such that with the spacer portion in position 32, the distance between the spacer portion 26 and front side 16 would correspond to the thickness of an interior door. If the spacer portion member is made of a flexible material the distance between the tip of the spacer portion or hook 26 and front side 16 may be less than the thickness of door 38. The top of spacer portion 26 should have a slight curve inward to make it easier to pull the door hook 10 down over the door when spacer portion 26 has been removed and reattached.

It should be understood that while the spacer portion 26 has been shown and described as being a J-hook, a differently shaped hook or other spacer portion having an appropriate shape and thickness may be utilized in place of a J-hook to allow the door hook 10 to securely fit on doors having different thickness by removing or reattaching a spacer portion to the back side of the hook. For example, the spacer portion may be L-shaped or a loop or a hemispherical shape. Any shape which provides the desired spacing may be used. Whatever shape is selected, there should not be any sharp edges in contact with the door in any configuration of the door hook. The embodiments shown in the drawings all meet this standard.

Figure 4:
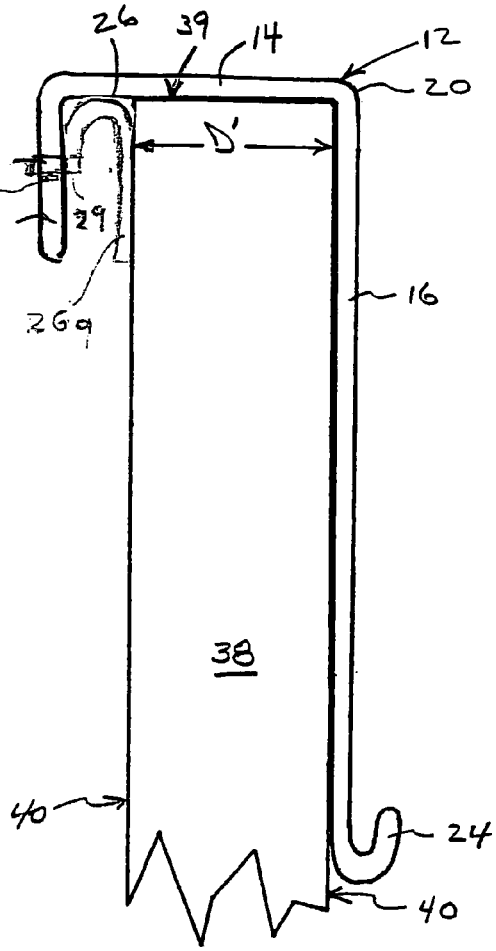
FIG. 4 is a side view similar to FIG. 3 of a second embodiment of a door hook according of the present invention secured over a door.
Figure 5:
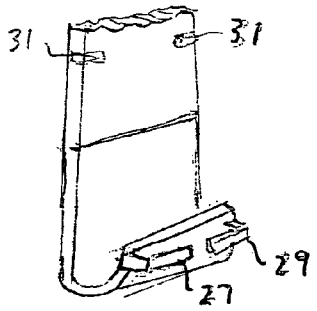
FIG. 5 is a perspective view of the back portion of the embodiment of FIG. 4 prior to detachment of the spacing member.

In the embodiment shown in FIGS. 1, 2 and 3, the spacer portion is reattached using double sided tape 25 on the back surface of the back side 16. Other locking devices such as a tongue and groove, mating slots or other arrangement commonly used to join two plastic or metal parts may be provided to reattach the spacer portion. In the embodiment of FIGS. 4 and 5, the spacer portion 26*a* has a pair of arms 27 and 29 that extend from the spacer portion. These arms fit over the back side when the spacer portion 26*a* is reattached as shown in FIG. 4. Bumps or projections 31 are provided on either side and the front face of back side 18 to retain the spacer member 26*a* in place after reattachment.

Figure 6:
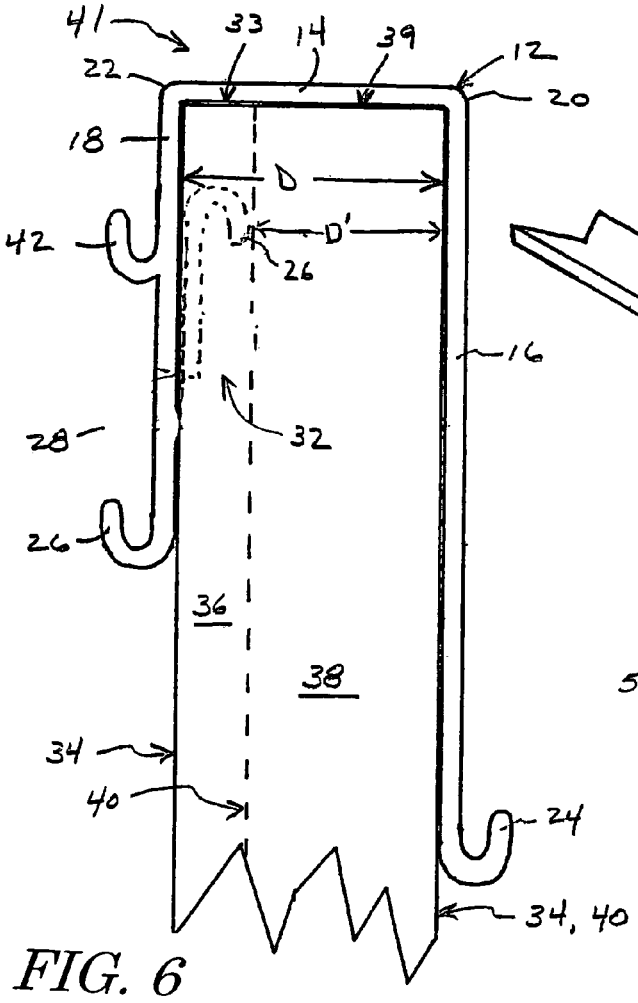
FIG. 6 is a partial perspective view of a third embodiment of a door hook according to the present invention.

A third second embodiment of the present invention is shown in FIG. 6 generally at 41, with like elements of FIGS. 1–3 indicated with the same reference numbers. An additional hook member 42 is attached to the back side 18 of the U-shaped bracket 12. The additional hook member 42 is positioned such that it is between the frangible joint 28 and the edge 22 of the top member 14. In this particular embodiment, with the spacer portion 26 in its original position, the door hook 41 may be snugly fit over the door 36 having a thickness corresponding to the distance D between the front 16 and back 18 sides. Additionally, with the spacer portion 26 in the reattached position, indicated by dotted lines 32, the door hook 41 may be snugly fit over the door 38 having a thickness corresponding to the distance D' between the spacer portion 26 and the front side 16. In either case, objects may still be attached to the hook 42 provided on the back side 18.

Figure 7:
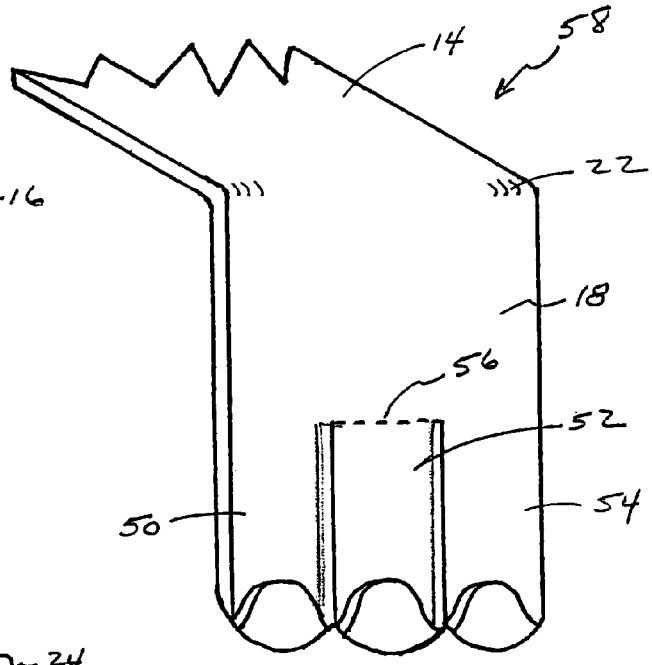
FIG. 7 is a partial perspective view of a fourth embodiment of a door hook according to the present invention.
Figure 8:
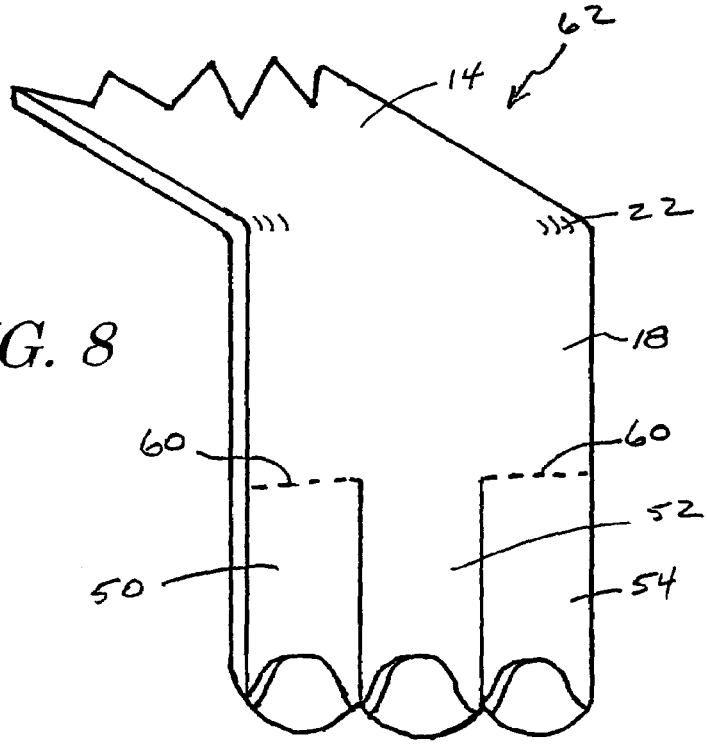
FIG. 8 is a perspective view of a fifth embodiment of a door hook according to the present invention.

FIGS. 7 and 8 illustrate further embodiments of the door hook according to the present invention, with like elements of FIGS. 1–3 indicated with the same reference numbers. For clarity, the front side 16 of the U-shaped bracket 12 has been omitted from FIGS. 7 and 8. In the embodiment of FIG. 7, first hook 50 and second hook 54 are positioned on either side of the detachable spacer portion 52. A frangible joint 56 is formed in the back side 18 allowing the spacer portion 52 to be removed from between the first and second hooks 50, 54.

In a slightly different embodiment, shown in FIG. 8, frangible joints 60 are provided in the back side 18 such that either or both of hooks 50 and 54 are removable and can be used as the spacer portion. The center portion 52 is not removable and remains available for attachment of objects thereto.

While most exterior doors are about 1¾ inches thick, many interior doors are two inches thick. Interior doors are usually 1⅜ inches in thickness. Therefore, we may provide that portions 50, 52 and 54 extend different distances from the back side 18. One distance may be ⅝", while the other is ¼". The ⅝ distance will provide a snug fit on doors having a thickness approximately equal to 1⅜" (2" minus ⅝"). The ¼" distance provides a snug fit on doors having a thickness approximately equal to 1¾" (2" minus ¼"). It should be understood that the various distances set forth herein are for exemplary purposes only, and other spacing and/or number of hooks may be utilized without departing from the spirit and scope of the present invention.

Figure 9:
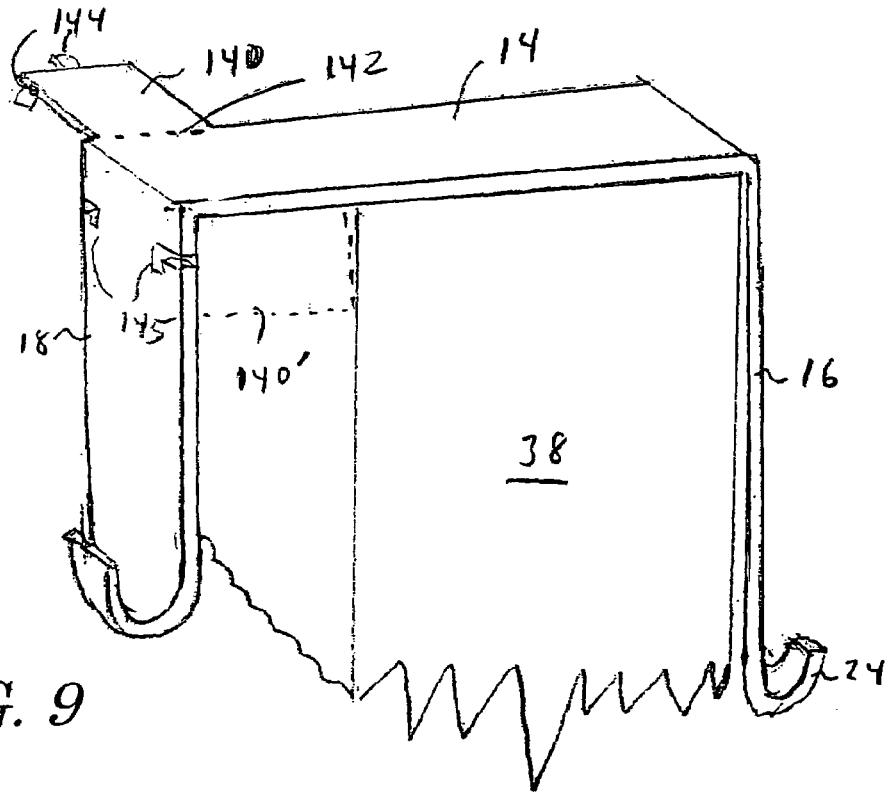
FIG. 9 is a perspective view of a sixth embodiment of a door hook according to the present invention.

While we prefer to provide the spacer portion in the back side of the door hook, that element could be part of the top or the front side. In the embodiment shown in FIG. 9, the top 14 is molded to have a spacer portion 140 extending from one or both edges of the top. Only one spacer portion is shown in FIG. 9 for ease of illustration. A frangible joint 142 is provided to enable the spacer portion 140 to be detached and reattached to a position 140' under the top 14 and act as a spacer between door 38 and back 18. A tab 144 is provided on the edge of spacer portion 140 which will seat in a slot 145 in the back surface of the back side 18 of the door hook keeping the spacer portion in position 140'. The same type of spacers could be molded to be part of the front side 16 or back side 18 rather than be part of the top 14.

Figure 10:
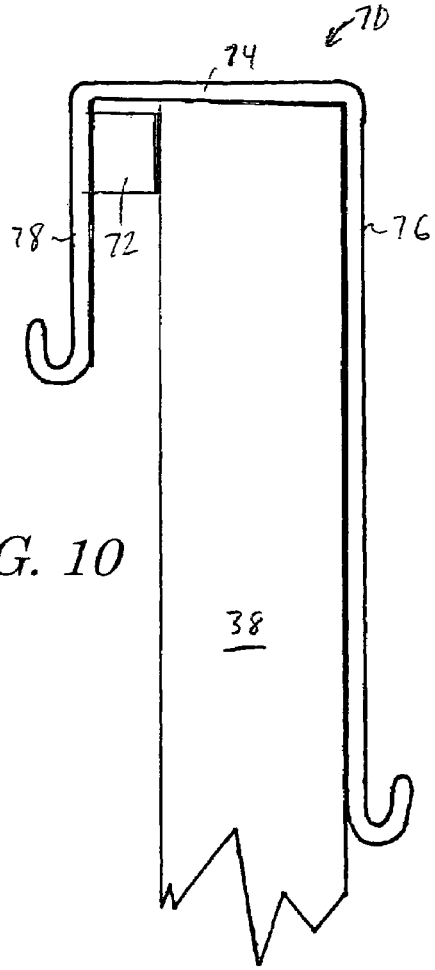
FIG. 10 is a side view of a seventh embodiment of a door hook according to the present invention.
Figure 11:
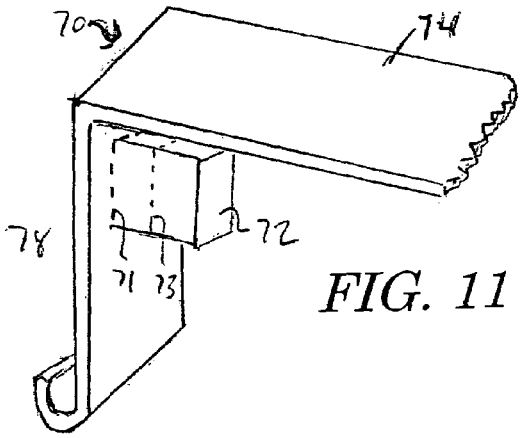
FIG. 11 is a perspective view of a portion of the door hook shown in FIG. 10.
Figure 2:
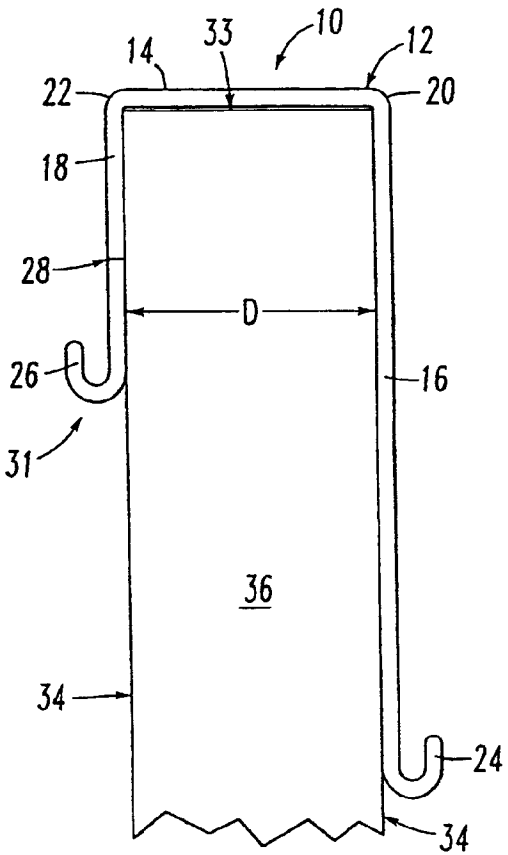
Figure 1:
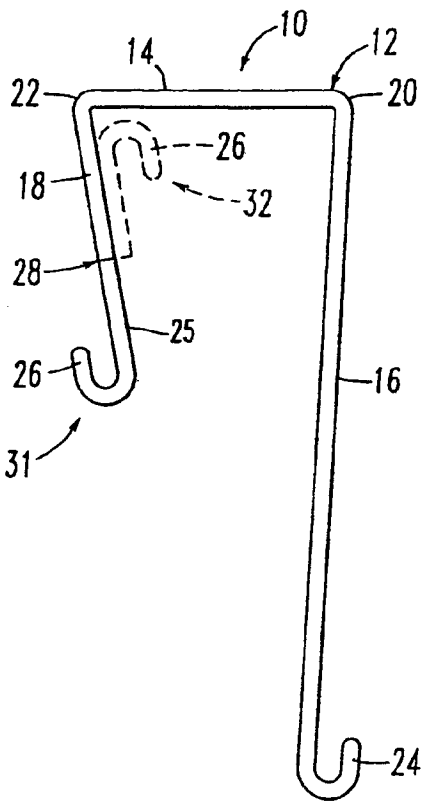
Figure 4:
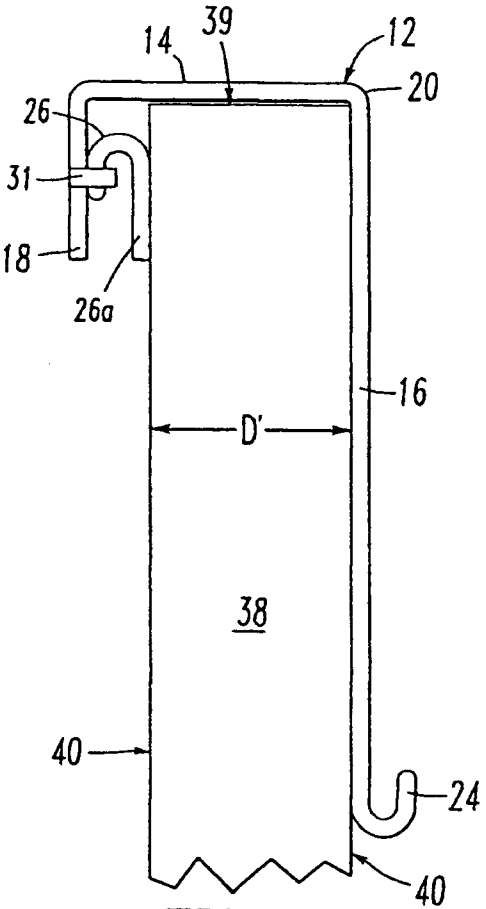
Figure 3:
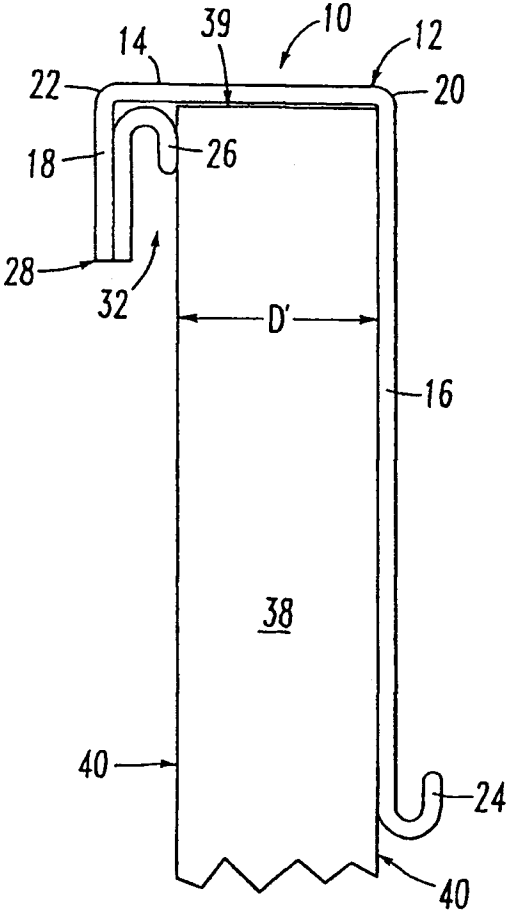
Figure 5:
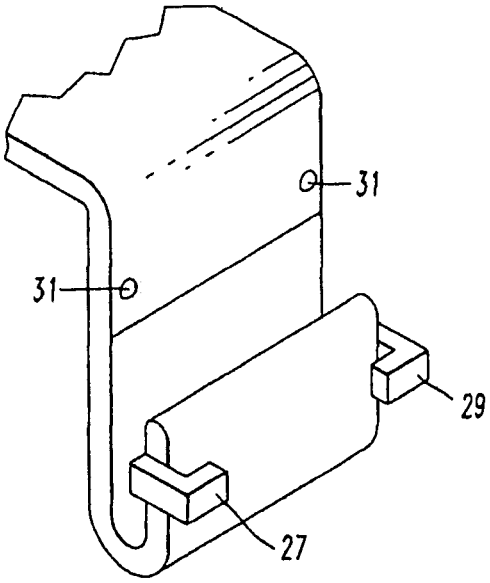
Figure 6:
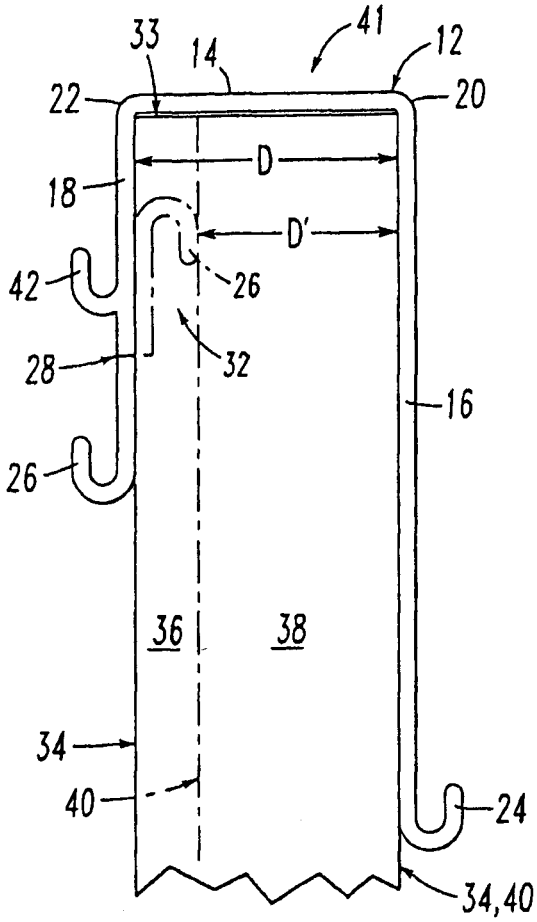
Figure 7:
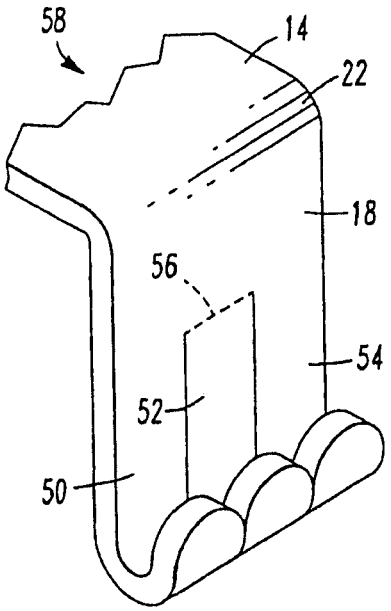
Figure 8:
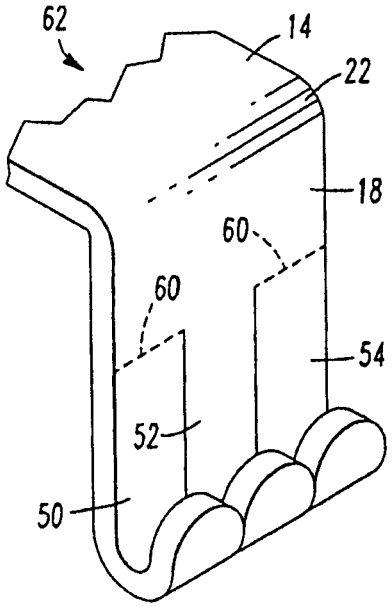
Figure 9:
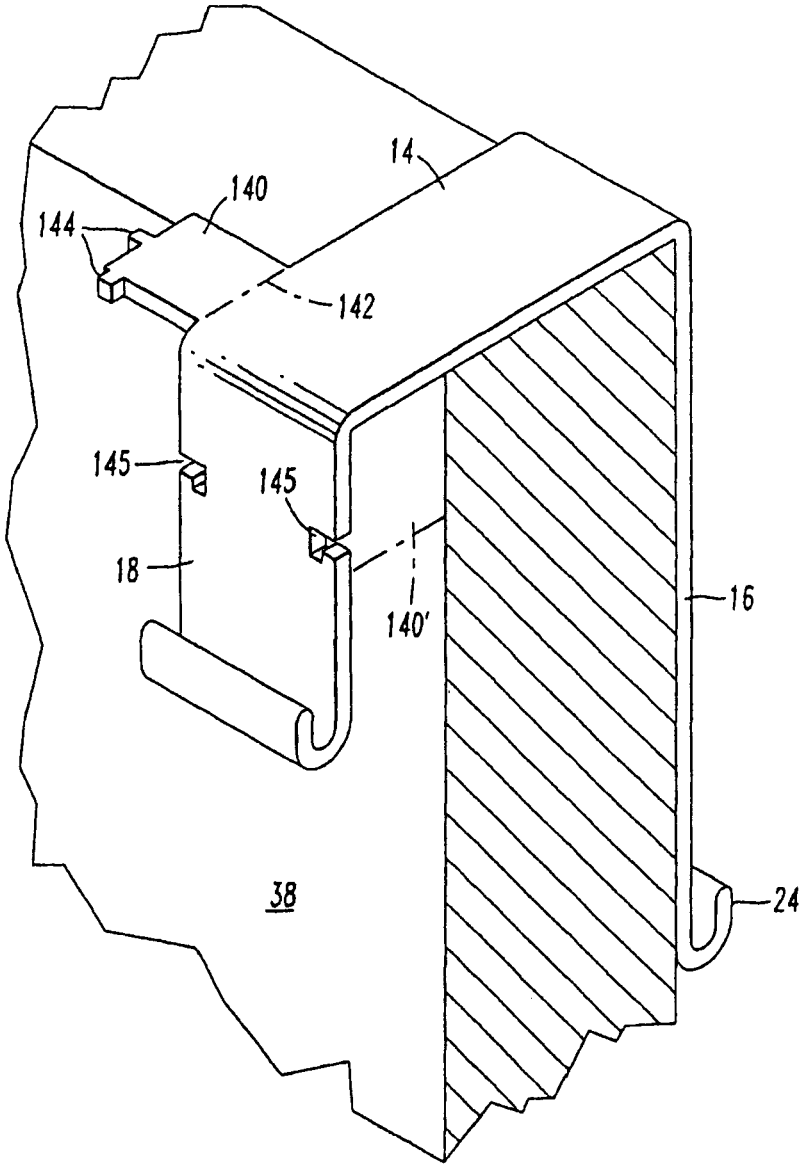
Figure 10:
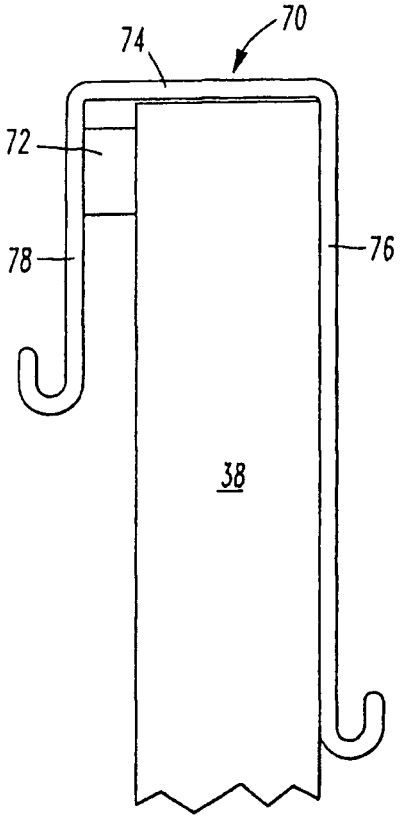
Figure 12:
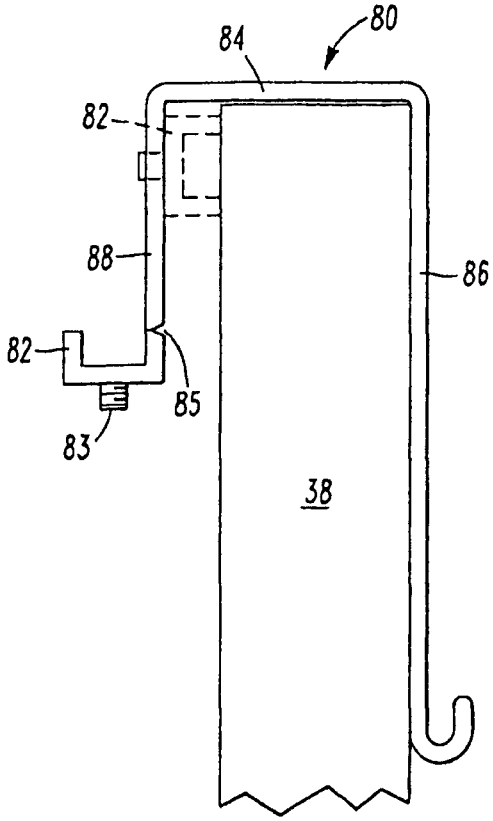
Figure 11:
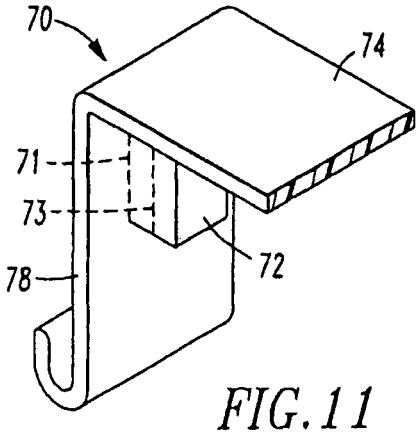

A seventh embodiment of our over-the-door hook 70 illustrated in FIGS. 10 and 11 has a spacer 72 adjacent the back side 78 and projects inward toward the front side 76. Although the spacer is shown as attached to the back side, the spacer could be attached to the top or to both the top and the back side. With the spacer attached, the door hook fits over the thinner door 38. Score lines or serrations 71, 73 are provided in the spacer so that all or a portion of the spacer 72 can be removed. With the spacer portion removed the door hook 70 will fit over a thicker door. If desired that spacer portion could be configured for reattachment to the door hook for use as a spacer or for any other purpose.

Figure 12:
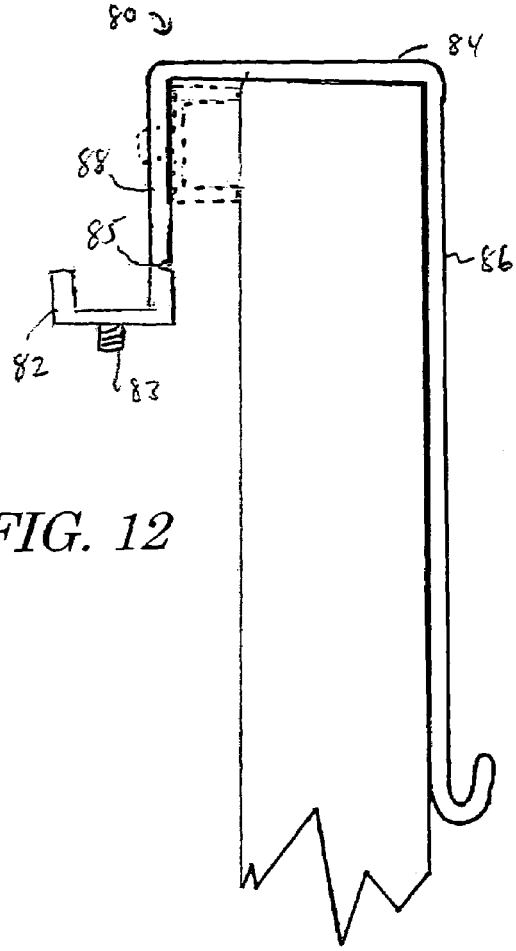
FIG. 12 is a side view of an eighth embodiment of a door hook according to the present invention in which the removed and reattached position of the space is shown in dotted line.

Referring to FIG. 12, the eighth embodiment of our door hook 80 has a top member 84, a front side 86 and a back side 88. A U-shaped spacer 82 is frangibly attached to the back side along joint 85. A threaded rod 83 extends from the bottom of the spacer. The threaded rod enables the detached spacer 82 to be reattached to the back side through a hole in the back side as indicated by the dotted lines. No tools are needed to detach the spacer and connect the spacer to the back side in the position shown in dotted line in FIG. 12.

In all of the illustrated embodiments the frangible joint may be made by molding, scoring or cutting a groove or serrations in the U-shaped bracket. It should be recognized that the U-shaped bracket and spacer portion could be two separate pieces connected by fabric, tape or other material to form a frangible or tearable connection.

While the present invention has been described with the particular reference to the drawings, it should be understood that various modifications could be made without departing from the spirit and scope of the present invention. Accordingly, the invention is not limited to the embodiments shown in the drawings, but may be variously embodied within the scope of the following claims.

We claim:

1. A door hook to be extended over a door top to both sides of a door, the door hook comprising a U-shaped bracket having:

a top member, a front side which is attached to one edge of the top member, and a back side which is attached to an other edge of the top member opposite the one edge, wherein the front side and back side are separated by a first distance;

a first hook member attached to the front side;

a spacer portion, the spacer portion being detachable from the U-shaped bracket and configured for reattachment to the back side such that the back side with the spacer portion reattached thereto and the front side are separated by a second distance between the front side and the spacer portion, the second distance being different from the first distance; and a hook attached to the spacer portion.

2. The door hook of claim 1 further comprising a second hook member attached to the back side.

3. A door hook to be extended over a door top to both sides of a door, the door hook comprising a U-shaped bracket having:

a top member, a front side which is attached to one edge of the top member, and a back side which is attached to an other edge of the top member opposite the one edge, wherein the front side and back side are separated by a first distance;

a first hook member attached to the front side; and a spacer portion, the spacer portion being detachable from the U-shaped bracket and configured for reattachment to the back side such that the back side with the spacer portion reattached thereto and the front side are separated by a second distance between the front side and the spacer portion, the second distance being different from the first distance;

wherein the spacer portion is connected to one of the top member, the front side and the back side by a frangible joint.

4. The door hook of claim 3 wherein the second distance is less than the first distance.

5. The door hook of claim 3 also comprising double sided tape attached to at least one of the back side and spacer portion.

6. The door hook of claim 3 wherein at least one of the front side and the back side is attached to the top member at an acute angle relative to the top member.

7. The door hook of claim 3 wherein the U-shaped bracket is a molded body and the spacer position of the U-shaped bracket is molded adjacent the back side.

8. The door hook of claim 3 wherein the U-shaped bracket is made of one of styrene, polycarbonate, polypropylene and a metal.

9. The door hook of claim 3 wherein the top member is approximately 0.050 to 0.080 inches thick.

10. The door hook of claim 3 also comprising at least one of a locking member and an adhesive on one of the back side and the spacer portion which locking member or adhesive is positioned to retain the spacer portion on the back side after that spacer portion has been reattached to the back side.

11. The door hook of claim 3 wherein the back side has a hole and a spacer portion further comprises a threaded portion which is positioned to fit into the hole and retain the spacer portion on the back side after that spacer portion has been reattached to the back side.

12. A door hook to be extended over a door top to both sides of a door, the door hook comprising a U-shaped bracket having:

a top member, a front side which is attached to one edge of the top member, and a back side which is attached to an other edge of the top member opposite the one edge, wherein the front side and back side are separated by a first distance;

a first hook member attached to the front side; and a spacer portion, the spacer portion being detachable from the U-shaped bracket and configured for reattachment to the back side such that the back side with the spacer portion reattached thereto and the front side are separated by a second distance between the front side and the spacer proton, the second difference being different from the first distance;

wherein the back portion and the spacer portion are plastic molded in a common plane and connected by a frangible joint.

13. A door hook to be extended over a door top to both sides of a door, the door hook comprising a U-shaped bracket having:

a top member, a front side which is attached to one edge of the top member, and a back side which is attached to an other edge of the top member opposite the one edge, wherein the front side and back side are separated by a first distance;

a first hook member attached to the front side; and a spacer portion, the spacer portion being detachable from the U-shaped bracket and configured for reattachment to the back side such that the back side with the spacer portion reattached thereto and the front side are separated by a second distance between the front side and the spacer portion, the second distance being different from the first distance;

wherein the spacer portion is connected to at least one of the back side and the top member by a frangible joint.

14. The door hook of claim 13 wherein the U-shaped bracket is made of one of styrene, polycarbonate, polypropylene and metal.

15. The door hook of claim 13 wherein the spacer portion is configured for reattachment to at least one of the top member, the front side and the back side.

* * * * *

UNITED STATES PATENT AND TRADEMARK OFFICE

CERTIFICATE OF CORRECTION

PATENT NO. : 7,207,088 B2
APPLICATION NO. : 10/790428
DATED : April 24, 2007
INVENTOR(S) : William E. Adams and George LeMieux It is certified that error appears in the above-identified patent and that said Letters Patent is hereby corrected as shown below:

The title page showing the illustrative should be deleted to be replaced with the attached title page.

The drawing sheets, consisting of Figs. 1-12, should be deleted to be replaced with the drawing sheets, consisting of Figs. 1-12, as shown on the attached pages.

Signed and Sealed this
First Day of February, 2011

David J. Kappos

David J. Kappos
*Director of the United States Patent and Trademark Office*

(12) United States Patent
Adams et al.

(10) Patent No.: US 7,207,088 B2
(45) Date of Patent: Apr. 24, 2007

(54) DOOR HOOK WITH REMOVABLE SPACER

(75) Inventors: William E. Adams, Harmony, PA (US); George LeMieux, Noblesville, IN (US)

(73) Assignee: Adams Mfg. Corp., Portersville, PA (US)

( * ) Notice: Subject to any disclaimer, the term of this patent is extended or adjusted under 35 U.S.C. 154(b) by 13 days.

(21) Appl. No.: 10/790,428

(22) Filed: Mar. 1, 2004

(65) Prior Publication Data

US 2005/0188507 A1 Sep. 1, 2005

(51) Int. Cl.
*A45F 5/10* (2006.01)
*E05D 13/00* (2006.01)

(52) U.S. Cl. ..... 16/413; 248/215; 248/304; 248/914; 16/404

(58) Field of Classification Search ..... 16/413, 16/404; 248/215, 304, 914
See application file for complete search history.

(56) References Cited

U.S. PATENT DOCUMENTS

| | | | | |
|---|---|---|---|---|
| 1,474,660 | A | 11/1923 | White | |
| 1,540,556 | A | 6/1925 | Laurie | |
| 2,743,023 | A * | 4/1956 | Larson | 211/96 |
| 3,536,286 | A | 10/1970 | Kramer | |
| 3,891,176 | A * | 6/1975 | Dowaing et al. | 248/340 |
| 3,907,118 | A * | 9/1975 | Pelavin | 211/113 |
| 4,034,865 | A | 7/1977 | Batts et al | |
| 4,387,873 | A * | 6/1983 | Pavlo et al. | 248/227.1 |
| 4,709,891 | A * | 12/1987 | Barnett | 248/214 |
| 4,817,239 | A | 4/1989 | Campbell | |
| D305,299 | S * | 1/1990 | Freeman | D8/373 |
| 5,087,007 | A | 2/1992 | Gaderick | |
| D326,021 | S | 5/1992 | Evenson | |

(Continued)

OTHER PUBLICATIONS

Photocopy of mainstays™ décor Over Door Hook on blister card which is commercial embodiment of U.S. Patent No. Des. 479,918.

*Primary Examiner*— Brian E. Glessner
*Assistant Examiner*-- Mark Williams
(74) *Attorney, Agent, or Firm* - Buchanan Ingersoll & Rooney PC

(57) ABSTRACT

A door hook including a U-shaped bracket having a top member and a front side and back side attached to the top member. The front and back sides are separated by a first distance, which corresponds generally to the thickness of a door over which the door hook is to be placed. A hook is attached to the front side, while a spacer portion is attached to the back side or top. A frangible joint is formed in the back side or top such that the spacer portion can be detached and then reattached to the back side. With the spacer portion in this reattached position the spacer portion and the front side are separated by a second distance, different front and typically less than the first-distance. The second distance corresponds generally to the thickness of a thinner or thicker door, over which the door hook may be placed after removal or removal and reattachment of the spacer. In this manner, the door hook may be easily adjusted to fit over doors having different thickness, such as, for example, exterior doors and interior doors. In an alternative embodiment the spacer portion is positioned to fit over a thinner door with the spacer portion in place and over a thicker door when the spacer portion is removed.

15 Claims, 5 Drawing Sheets

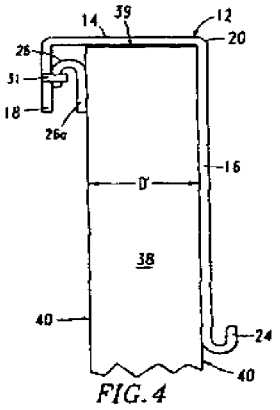

*FIG. 4*